United States Patent [19]

Dischert

[11] 3,952,267

[45] Apr. 20, 1976

[54] METAL SPRAY FORMING OF WAVEGUIDE FOR PHASE SHIFTER CASE

[75] Inventor: William A. Dischert, Jobstown, N.J.

[73] Assignee: The United States of America as represented by the Secretary of the Navy, Washington, D.C.

[22] Filed: Jan. 3, 1975

[21] Appl. No.: 538,639

[52] U.S. Cl. ..... 333/24.1; 29/600; 333/98 R

[51] Int. Cl.[2] ..... H01P 1/40; H01P 11/00

[58] Field of Search ..... 333/24.1, 98 R; 29/600

[56] References Cited

UNITED STATES PATENTS

| | | | |
|---|---|---|---|
| 3,408,597 | 10/1968 | Heiter | 333/24.1 |
| 3,686,590 | 8/1972 | Dischert | 333/24.1 |
| 3,760,305 | 9/1973 | Mason et al. | 333/24.1 X |

OTHER PUBLICATIONS

Ince et al., A Method of Fabrication . . . Toroidal Ferrite Phases, IEEE, Trans. on MTT, Oct. 1972, pp. 705–707.

*Primary Examiner*—Paul L. Gensler
*Attorney, Agent, or Firm*—R. Sciascia; R. Beers; S. Scheinbein

[57] ABSTRACT

A metal phase shifter case construction involves connecting two channel-shaped pieces of aluminum, one on each side of a ferrite toroid, and then spraying standard metal spray onto the toroid to electrically join the two channels together.

6 Claims, 2 Drawing Figures

METAL SPRAY FORMING OF WAVEGUIDE FOR PHASE SHIFTER CASE

BACKGROUND OF THE INVENTION

The present invention relates generally to the field of waveguides and, more particularly, to a metal sprayed phase-shifter guide construction. Present methods of forming phase-shifters require the insertion of a ferrite toroid assembly into a drawn metal waveguide. During insertion of the toroid assembly the connecting wire must be brought out through holes in the waveguide, a difficult operation which often damages the wires. The contact between the surfaces of the toroid and the inner walls of the waveguide is difficult to control even with very precise parts.

SUMMARY OF THE INVENTION

In the present invention, the metal sprayed phase-shifter case is constructed by placing two channels of metal, such as aluminum, against the sides of the ferrite toroid assembly. The wires are easily brought out through holes in one of the channels. The assembly is fixtured and aluminum is sprayed across the ferrite toroid and the two channels. This forms a continuous aluminum case around the toroid assembly with intimate contact throughout the entire surface of the ferrite. This mode of construction overcomes the problems of the prior art mentioned.

OBJECTS OF THE INVENTION

An object of the invention is to provide an improved method of forming a phase-shifter case.

Another object of the invention is to construct an improved simplified low cost metal phase-shifter and surrounding electrical conductor construction wherein a close fit is maintained between the ferrite toroid and its metal case.

Other objects, advantages and novel features of the present invention will become apparent from the following detailed description of the invention when considered in conjunction with the accompanying drawings.

DETAILED DESCRIPTION

Figure 1:
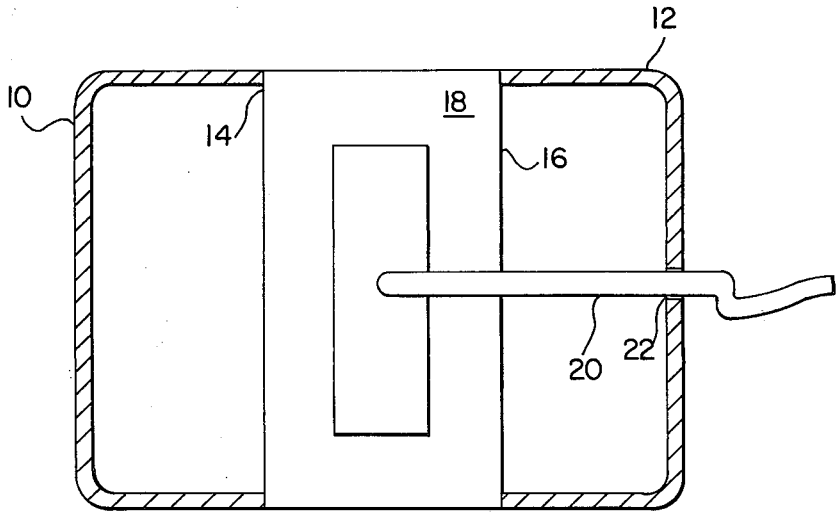
FIG. 1 is a cross-sectional diagram of the assembled metallic channels and ferrite core before the metal spray is applied.

FIG. 1 demonstrates the first steps of the present method. Two metal channels 10 and 12, which may be aluminum, are placed against the sides, 14 and 16 respectively, of a ferrite toroid assembly 18. The wires 20 from the toroid 18 may be easily brought out through a hole 22 in one of the channels. The toroid 18 may be only one of a plurality of such toroids spaced from each other along the length of the channels to form a stack.

Figure 2:
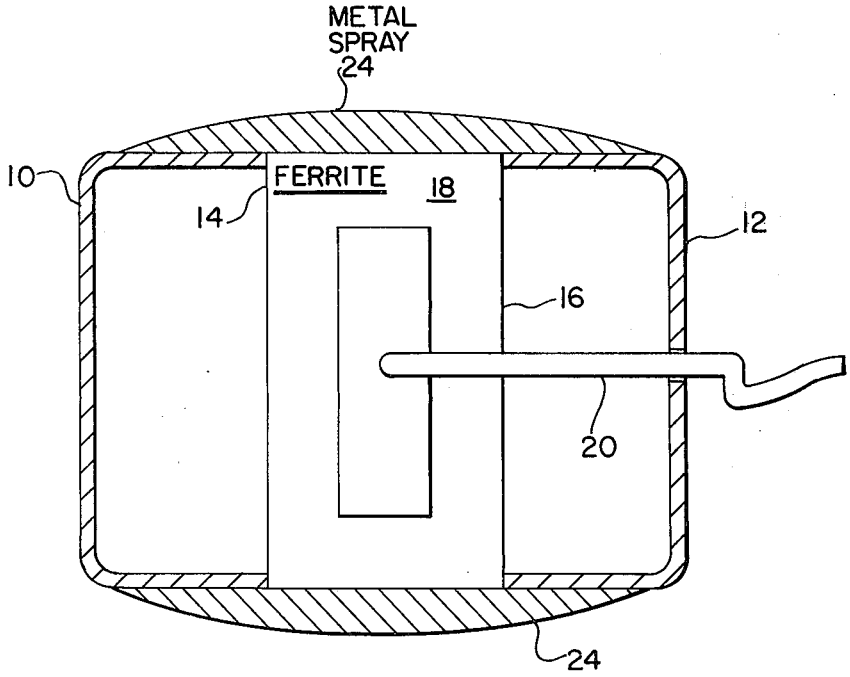
FIG. 2 is a cross-sectional diagram of the finished assemblage.

As shown in FIG. 2, the assembly is then completed by depositing a metal spray 24, which may be a conventional aluminum wire-fed type, across the top and bottom of the assembly to form an electrically continuous aluminum case around the toroid assembly 18, with intimate electrical contact being maintained throughout the entire surface of the ferrite.

This method of construction also eliminates many assembly problems since the ferrite assembly 18 with its several sections and wires 20 can be fixtured and adjusted with the wires 20 arranged through holes 22 in the channel 12 prior to metal spraying. Plasma sprays of an electrically conducting nature could also be used in place of the wire-fed metal spray.

Obviously, many modifications and variations of the present invention are possible in light of the above teachings. It is therefore to be understood that, within the scope of the appended claims, the invention may be practiced otherwise than as specifically described.

What is claimed is:

1. A method of forming a metal phase-shifter case comprising:

assembling a pair of channel-shaped pieces of metal on both sides of and in contact with a ferrite toroid assembly, each of said channel-shaped pieces having a pair of parallel leg sections and an intermediate orthogonal center section, the free ends of said leg sections contacting the sides of said ferrite toroid assembly flush with the top and bottom, respectively, of said assembly; and spraying a metal over the top and bottom of said assembly and over the leg sections of said channel pieces to form a continuous metal case around said assembly.

2. The method of claim 1 wherein said metal and said channel-shaped pieces of metal are aluminum.

3. The method of claim 1 wherein said spraying comprises spraying a plasma of an electrically conducting nature.

4. A metal phase-shifter assembly comprising:

a ferrite toroid assembly forming the center of said metal phase-shifter assembly;

a pair of channel-shaped pieces of metal each having a pair of parallel leg sections and an intermediate center section, said pieces abutting the sides of said ferrite toroid assembly and the free ends of said leg sections in contact therewith flush with the top and bottom of said ferrite toroid assembly;

a metal sprayed over the top and bottom of said ferrite toroid assembly and the leg sections of said channel-shaped pieces so that a continuous electrical connection is maintained at the point where said ferrite toroid assembly and said channel-shaped pieces contact.

5. A metal phase-shifter assembly as recited in claim 4 whererin said metal and said channel-shaped pieces of metal are aluminum.

6. A metal phase-shifter assembly as recited in claim 4 wherein said metal is a plasma of an electrically conducting nature.

* * * * *